United States Patent [19]

Lovell et al.

[11] Patent Number: 4,953,372

[45] Date of Patent: Sep. 4, 1990

[54] INEXPENSIVE KEYLESS USER CUSTOM CODED LOCK

[76] Inventors: Walter C. Lovell, 348 Mountain Rd., Wilbraham, Mass. 01095; Robert L. Nathans, 36 Stag Dr., Billerica, Mass. 01821

[21] Appl. No.: 247,675

[22] Filed: Sep. 22, 1988

[51] Int. Cl.[5] ..... E05B 65/00

[52] U.S. Cl. ..... 70/89; 70/90; 70/74

[58] Field of Search ..... 70/89, 90, 69–75

[56] References Cited

U.S. PATENT DOCUMENTS

| | | | |
|---|---|---|---|
| 534,987 | 3/1895 | Alsdorf | 70/90 X |
| 546,649 | 9/1985 | Bray | 70/90 |
| 638,492 | 12/1899 | Barr | 70/90 |
| 825,616 | 7/1906 | Rosenberg | 70/90 |
| 1,841,334 | 1/1932 | Long | 70/74 |
| 2,131,315 | 9/1938 | Dunseath | 70/90 |
| 2,634,146 | 4/1953 | Johnson | 70/89 X |
| 2,648,966 | 8/1953 | Polak | 70/74 |
| 3,152,467 | 10/1964 | Fanning | 70/74 |
| 3,186,198 | 6/1965 | Noerrenberg-Sudhaus | 70/74 |
| 3,279,226 | 10/1966 | Chance | 70/74 X |
| 3,350,902 | 11/1967 | Chance | 70/74 |
| 3,934,908 | 1/1976 | Rifkin | 70/89 X |
| 3,956,911 | 5/1976 | Corboud | 70/90 X |
| 4,050,724 | 9/1977 | Nakanishi | 70/89 X |
| 4,771,617 | 9/1988 | Dueringer | 70/74 |

*Primary Examiner*—Robert L. Wolfe
*Assistant Examiner*—Suzanne L. Dino
*Attorney, Agent, or Firm*—Robert L. Nathans

[57] ABSTRACT

Very simple, inexpensive keyless window sash combination code lock has a pivotable cover plate for preventing an intruder from unscrewing the conventional screws for mounting the lock to the sashes. Three combination code dials are slip coupled to associated rotatable pins which pass through the cover plate and an apertured anchor plate. The pins have lugs positioned under the anchor plate to prevent the lock from being opened. When the lugs are positioned within the anchor plate upon installation, the user rotates the dials to create his own custom combination code. The cover plate is then lowered, the dials are rotated and the lock is locked. The code dials are press fitted about the cylindrical locking pins to save manufacturing costs, and the manual sensing of the correct positioning of the code dials by an intruder, to open the lock, is prevented by providing radial dummy recesses in the lower surface of the anchor plate about each locking pin.

14 Claims, 1 Drawing Sheet

INEXPENSIVE KEYLESS USER CUSTOM CODED LOCK

BACKGROUND OF THE INVENTION

The present invention relates to the field of window sash locks.

Burglaries in the United States have been increasing at alarming rates. Typically, a burglar breaks a window pane and actuates the sash latch to enable him to open the window and enter the home. Many homeowners have spent considerable sums on burglar alarm systems which often cost thousands of dollars. These systems are subject to false alarms which can be very annoying to the occupants, neighbors, and to the police. Also, many people cannot afford them.

Another solution to this problem is to bore holes through the upper and lower sash, and insert pins through the holes. Although most people can handle conventional screwdrivers, boring holes is an unsuitable task for many.

One kit on the market instructs the homeowner to use a special wrench to screw the pins through the holes bored by the homeowner. The pins, recessed within the boreholes, then prevent motion of the upper or lower sash to thus deter a burglar. However, each time the occupant wishes to open the windows he must insert the special wrench supplied with the kit into the boreholes and rotate the wrench until the pins are retracted. This is a nuisance, and the wrenches can be lost. Another similar technique is to insert pins through the boreholes until the heads of the pins are flush with lefthand and righthand inside surfaces of the sash. A magnet is applied to the pin heads to retract the pins from the upper sash borehole. Often, the magnets will not work since the boreholes in each sash are not exactly aligned with each other, to produce a resistance force which cannot be overcome by the magnet. The windowsashes must then be "jiggled" until the alignment is corrected to permit the magnet to withdraw the pins, which is a time consuming annoyance. Also, the security of these devices is very limited, as the burglar can obtain the special wrench and the magnet from the same source as the homeowner.

Window sash latches or slidable bolts are also marketed having key actuated locks built therein. Since the screws for maintaining the locks in position are exposed, screws with regular heads are not used, since the burglar can break the window and easily employ an ordinary screwdriver to unscrew the locks. Hence "one way" screw heads are used, and the screws cannot be unscrewed by the user with a screwdriver. If the fixtures are misaligned upon being mounted upon the upper and lower sash during installation by the often inexperienced user, he or she is in trouble since the "one way" screws cannot be removed with a screwdriver for a second "try". However, the "one way" screws can be sheared off with a hammer and chisel or may often be removed by a gripper type wrench, so that these key actuated locks mounted with "one way" screws, still only provide limited real security.

Also, inevitably, at least one of the two keys supplied with these devices get lost. When keys are duplicated, typically several times over the years, they may no longer open the locks due to tolerance variations upon duplication. Also, locks for one set of windows may require different keys than locks for other sets of windows, to cause confusion and annoyance. Additionally, if both keys supplied for each lock are lost, the user will often hire a locksmith to create a new key which costs much more than the initial price of the lock, or may eventually obtain the services of a handy person who would know how to shear off the screw heads or remove them with a gripper wrench. Thus, what is really needed is a high security lock which is installed with ordinary "two way" screws.

SUMMARY OF PREFERRED EMBODIMENTS OF THE INVENTION

Thus, it is an object of the present invention to provide a windowsash lock which avoids the aforesaid problems, enhances security, and is very inexpensive to manufacture owing to its simplicity. It is a further object of the invention to provide a keyless lock which is rugged, and compact. The first or last three numbers of the users social security number, drivers license, birthday, etc. cannot be "lost" like an ordinary key; yet hundreds of combinations are provided by our simple and thus inexpensive lock.

In accordance with the preferred embodiment of the present invention, a first anchor plate is mounted upon the upper sash ledge by means of ordinary wood screws, and a second anchor plate is mounted upon the lower sash, also by utilizing ordinary wood screws. Hence, if the often inexperienced user mounts them in a misaligned fashion during installation, the conventional screws can be unscrewed with an ordinary screwdriver, and the user can try again, unlike the "one way" screws of the key actuated prior art. A stiff, strong cover plate is pivotably coupled to the first anchor plate and supports a set of rotatable code input shafts or pins, which pass through an apertured plate of the second anchor means, such rotatable pins having locking lugs at their lower portions which are blocked by the adjacent apertured plate, to prevent the pivotable cover plate from being separated from the second anchor means, thereby to lock the sashes together. While in this locked position, the cover plate covers all of the ordinary screw heads, to prevent the burglar from unscrewing them.

A numerically marked coding disk is press fitted about upper portions of each of the rotatable code input pins, and the user rotates each disk in accordance with the customized combination code he desires, preferably a group of three numbers lifted out of his social security number, birthday, etc., in a manner to be described. Then the cover plate is closed, the disks are rotated, and the lugs, positioned under the apertured plate of the second anchor means, will prevent the lock from being opened. Only when all lugs are aligned with apertured portions of the second anchor plate, after the pins are rotated in accordance with the proper code, can the lock be opened.

Dummy recesses are also formed in the apertured plate to deter an intruder from manually sensing the correct angular position of each rotatable coding element required to open the lock. The three digit number, extracted from the users social security number, birthday, etc. is easy to remember, cannot be "lost" (like a key), and need not be replaced.

Other objects, features and advantages of the present invention will become apparent upon study of the following detailed description, taken in conjunction with the drawings in which.

DETAILED DESCRIPTION OF PREFERRED EMBODIMENTS OF THE INVENTION

Figure 1:
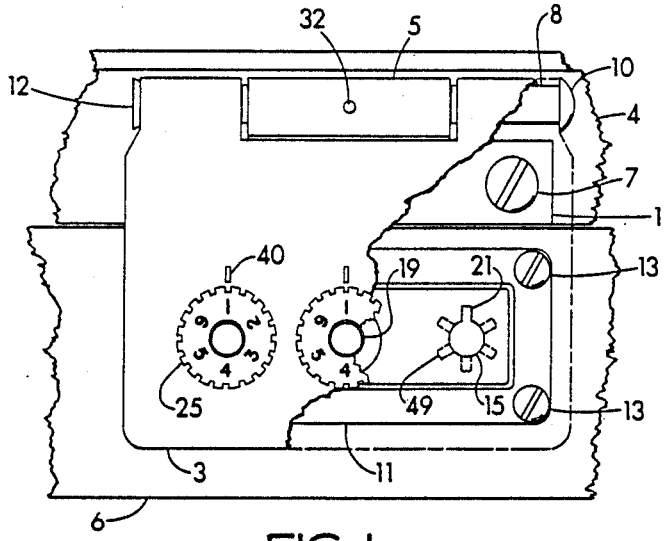
FIG. 1 is a plan view of the most preferred lock.
Figure 2:
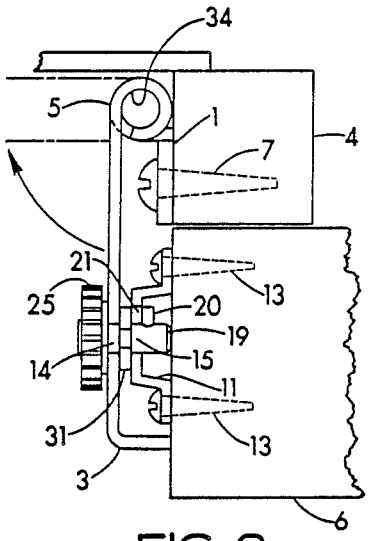
FIG. 2 is a side view of the most preferred lock.
Figure 3:
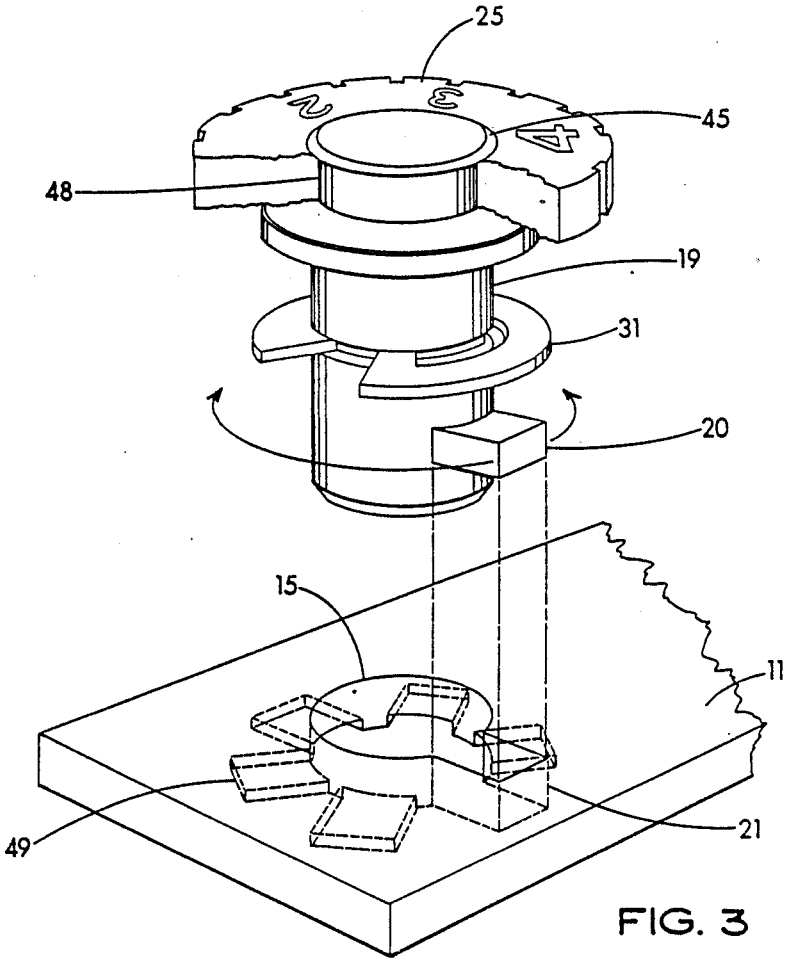
FIG. 3 illustrates further details of the rotatable components of the lock.

As illustrated in FIGS. 1–3, a first anchor plate 1 is mounted upon the horizontal surface of upper window sash 4 by means of a pair of ordinary wood screws, one shown at 7. Cover plate 3 is pivotably coupled to anchor plate 1 via hinge member 5, having retaining head 10 and a swaged portion 12 to maintain the hinge pin 8 in position as shown.

Three holes 15 are formed within the second anchor means 11, to thus produce an apertured anchor plate secured to the upper horizontal surface of the lower sash 6 by four ordinary wood screws 13. Circular holes 14 are also formed within cover plate 3 and are aligned with holes 15 in the apertured anchor plate. A code input member including a rotatable coding shaft or pin 19 is passed through each of the three sets of holes 14 and 15. Three blocking members or locking lugs 20 are thereafter mounted upon lower portions of the shafts 19 and are adjacent solid portions of the lower surface of the apertured plate, as shown in FIG. 2, when the lock is locked. Angular pin position indicating elements, preferably consisting of nylon coding disks 25, bearing indicia such as numbers or letters are press fitted about the upper portions of code input pins 19.

A template is supplied with the lock and enables the user to produce accurately placed screw positioning marks on the ledges of the sashes with a hammer and nail, or one of the screws supplied, to properly align the anchor plates with respect to each other and upon the sashes. Two screws 7 and four screws 13 serve to mount the first and second anchor plates to upper sash 4 and to lower sash 6 respectively. Unlike the aforesaid prior art "one way" screws, if the anchor plates are misaligned the user may try again.

After installation of the anchor plates, locking lugs 20 will be aligned with through passageways 21, as they are shipped in this condition with the "1" indicia adjacent the fiducial mark 40 for each coding disk, thus enabling the cover plate to be raised about ¼ inch to accept the users customized code. The user rotates cover plate 3 until each locking lug 20 is coplanar with the apertured plate and is nested in passageway 21. A torque is applied to the first coding disk 25, sufficient to cause slippage or relative angular rotation between the disk 25 and the pin 19 which cannot rotate since lug 20 is within its associated passageway 21. The disk is rotated until the indicia of the first digit of the user's customized code is adjacent fiducial 40. The process is repeated for the second and third disks. The relative angular position of each coding disk with respect to its associated coding pin is now maintained by means of snap rings 31.

The lock has now been custom coded and cover plate 3 is lowered, and the disks are rotated to lock the lock. At this time locking lugs 20 will be adjacent solid portions of the apertured plate of the second anchor device, which solid portions prevent cover plate 3 from being raised, which in turn prevents relative motion between the upper and lower sashes. The user thereafter unlocks the lock by turning the coding disks or angular position indicating elements 25 in accordance with his customized code to cause each locking lug 20 to again be aligned with each associated passageway 21 which permits each locking lug 20 to pass completely through its associated passageway 21 during manual rotation of the cover plate toward the vertical position. If one or more of the disks have the wrong angular position, the lug(s) will prevent rotation of the cover plate and the lock remains locked. Accordingly, the pins and their associated lugs perform the double function of acting as coding elements and locking latches.

In contrast to the aforesaid customized encoding operation, less torque will be applied to properly angularly position the rotatable pins bearing the locking lugs, since the lugs are beneath the apertured plate of the second anchor plate, rather than being within the passageways 21, preventing rotation of the pins bearing the lugs. This lesser torque for turning the disks during normal operation will, of course, not cause relative rotation between the nylon shaft position indicating disks 25 and the rotatable pin elements bearing the locking lugs 20, due to the friction fit 48 between the disks and the coding pins.

As shown in FIG. 3, retainer lip 45 extends from the top of each coding pin by about two mils, and the press or friction fit (slip coupling) is produced by having the inside diameter of nylon disk 25 be several mils less than the outside diameter of the top portion of the coding pin at 48. This type of fit is well known to workers in the art and need not be further explained. Should the burglar pry off one or more of the disks 25, the pins will still prevent the lock from being opened. However, since there are only 216 combinations, the user will be able to cycle through all combinations in twenty minutes or so to open the lock and replace it. In reality, the intruder will not risk the time required to find the combination in this way. If desired, 1296 combinations may be easily provided by adding an extra coding pin unit shown in FIG. 3 (216*6).

In accordance with another feature of the invention, five recesses 49 are formed in the lower surface portion of the apertured anchor plate surrounding each pin and do not extend through the plate, as best shown in FIG. 3. In their absence, the burglar may, by pulling upwardly upon the disk during its rotation, sense a slight mechanical shock as the lug 20 enters the passageway 21, indicating the "correct" angular position. This effect is also produced by the recesses, and thus such tactile sensing of the "correct" position of the locking lug is no longer possible.

In accordance with another feature of the invention, cover plate 3 is maintained in a vertical position when the lock is open by a detent formed upon hinge member 5, such detent preferably comprising nub 32 which snaps into an associated recess 34 formed within hinge pin 8. Should its vertical position with respect to the horizontally oriented apertured anchor plate not be maintained, the complete lowering of the lower sash could be blocked by the cover plate unless the user reaches between the sashes to manually moved it back to a vertical position, which is a nuisance.

The aforesaid embodiments are merely exemplary, and thus the scope of the invention is to be determined by a reasonable interpretation of the terms of the following claims and art recognized equivalents thereof.

What is claimed is:

1. A method of enabling user customization of a combination code of a lock comprising the steps of:

(a) providing a lock for preventing relative movement between a first component and a second component including;

(a-1) first and second anchor means to be fastened to said first and second component respectively, said second anchor means including an apertured member having an upper portion and a lower portion, together with aperture means formed therethrough, and a movable cover plate means;

(a-2) cover plate coupling means for coupling said cover plate means to said first anchor means;

(a-3) a plurality of individually rotatable coding elements extending through said cover plate means and said aperture means and each having an angular position indicating element coupled thereto via a slip coupling means, and each rotatable coding element having a blocking member coupled thereto and positioned beneath the lower portion of said apertured member when said lock is locked, and wherein said aperture means includes a passageway associated with each of said rotatable coding elements for permitting each of said blocking members to completely pass through an associated passageway upon the proper angular settings of each of said rotatable coding elements required to open said lock;

(b) positioning said cover plate means with respect to said second anchor means for causing said blocking members to co-act with said second anchor means to prevent rotation of said rotatable coding elements;

(c) selectively rotating each angular position indicating element, in accordance with a user created combination code, relative to an associated coding element by virtue of said slip coupling and a reaction torque produced by each blocking member co-acting with said second anchor means, while maintaining said cover plate means in the position set forth in paragraph (b);

(d) lowering said cover plate means to position each blocking member beneath said apertured member of said second anchor means; and (e) rotating each angular position indicating element causing each blocking member to be displaced from its associated passageway to lock said lock.

2. The method of claim 1 wherein step (b) includes positioning said cover plate means with respect to said second anchor means for causing each blocking member to be positioned within an associated passageway of said apertured member.

3. The method of claim 2 wherein said positioning of said cover plate means is performed by rotating said cover plate means about said cover plate coupling means.

4. A combination lock for preventing relative movement between a first member and a second member comprising:

(a) first anchor means to be fastened to said first member and second anchor means to be fastened to said second member, said second anchor means having an upper portion and a lower portion;

(b) cover plate means;

(c) cover plate coupling means for coupling said cover plate means to said first anchor means;

(d) a plurality of combination code input members individually movable with respect to said second anchor means and each being capable of selectively assuming at least three coding positions;

(e) a plurality of locking means, each coupled to one of said combination code input members and each being positioned beneath the lower portion of said second anchor means when said lock is locked and capable of being aligned with passageway means of said second anchor means, which passageway means is configured to enable each locking means to pass completely therethrough upon the separation of said cover plate means from said second anchor means but only after proper settings of said combination code input members have been carried out; and (f) a plurality of dummy recesses formed in said second anchor means for preventing an intruder from manually sensing the alignment of said locking means with respect to said passageway means.

5. The combination lock of claim 4 wherein said plurality of dummy recesses extend only partially through said second anchor means and substantially surround each of said combination code input members.

6. The combination lock of claim 4 further including slip coupling means for coupling each of a plurality of position indicating means with an associated one of said combination code input members for permitting relative motion therebetween upon the positioning of said locking means within said passageway means to enable easy and rapid customization of said combination lock.

7. The combination lock of claim 6 wherein each slip coupling means consists of a press fit between portions of each position indicating means and its associated combination code input member.

8. The combination lock of claim 7 wherein each combination code input member comprises a rotatable cylindrical shaft and each position indicating means comprises a single piece indicia bearing dial press fitted about its associated cylindrical shaft.

9. The combination lock of claim 4 further including detent means for maintaining said cover plate means perpendicular with respect to said second anchor means.

10. The lock of claim 4 wherein said dummy recesses extend only a slight distance into the lower portion of said second anchor means.

11. A combination code window sash lock for preventing relative movement between a first upper window sash and a second lower window sash when said lock is locked comprising:

(a) first anchor means fastened to a horizontally oriented portion of said first sash and second anchor means fastened to a horizontally oriented portion of said second sash, said second anchor means having an upper portion and a lower portion, together with passageway means formed within said second anchor means;

(b) cover plate means;

(c) cover plate coupling means for coupling said cover plate means to said first anchor means, together with detent means for maintaining said cover plate means in a vertical position after said lock is unlocked to permit relative movement of said first window sash with respect to said second window sash without blocking the complete lowering of said second lower sash by the cover plate assuming a non-vertical position;

(d) a plurality of combination code input members individually movable with respect to said cover plate means and mounted thereon, each being capable of assuming at least three coding positions;

(e) locking means coupled to said combination code input members and positioned beneath the lower portion of said second anchor means and capable of being aligned with the passageway means of said second anchor means to enable said locking means to pass completely through said passageway means upon the movement of said cover plate means with respect to said first anchor means but only after the proper settings of said combination code input members have been carried out; and (f) further including a plurality of dummy recesses for receiving said locking means in order to prevent an intruder from manually sensing the alignment of said locking means with respect to said passageway means.

12. The lock of claim 11 including a plurality of position indicating means together with a plurality of slip coupling means for coupling each position indicating means to an associated one of said combination code input members for permitting relative motion therebetween upon the positioning of said locking means within said passageway means to enable easy and rapid customization of said combination code.

13. The lock of claim 12 wherein each slip coupling means comprises a press fit between portions of each position indicating means and its associated combination code input member.

14. The lock of claim 13 wherein each combination code input member comprises a rotatable cylindrical shaft and each position indicating means comprises a single piece indicia bearing dial press fitted about its associated shaft.

* * * * *